US005273472A

United States Patent [19]

Skedeleski et al.

[11] Patent Number: 5,273,472

[45] Date of Patent: Dec. 28, 1993

[54] SURFBOARD FINS WITH FLEXIBLE EDGES

[75] Inventors: David Skedeleski; Eric Arakawa, both of Aiea, Hi.

[73] Assignee: Surfco Hawaii, Aiea, Hi.

[21] Appl. No.: 788,459

[22] Filed: Nov. 6, 1991

[51] Int. Cl.[5] ..... B63B 1/00

[52] U.S. Cl. ..... 441/79; 114/140

[58] Field of Search ..... 441/74, 79; 114/140, 114/39.2

[56] References Cited

U.S. PATENT DOCUMENTS

| | | | |
|---|---|---|---|
| 3,082,444 | 3/1963 | Estes | 9/310 |
| 3,428,980 | 2/1969 | Newton | 9/329 |
| 3,543,315 | 12/1970 | Hoffman | 9/310 |
| 3,585,957 | 6/1971 | Rich | 114/140 |
| 3,804,049 | 4/1974 | Greer | 114/67 A |
| 3,890,661 | 6/1975 | Johnson | 9/310 |
| 4,129,911 | 12/1978 | McDonald et al. | 441/74 |
| 4,209,867 | 7/1980 | Abrams, III | 9/310 E |
| 4,325,154 | 4/1982 | Collum, Jr. | 441/74 |
| 4,720,280 | 1/1988 | Hufnagl et al. | 441/74 |
| 4,904,215 | 2/1990 | Sherwood | 441/79 |
| 4,923,427 | 5/1990 | Roland | 441/79 |
| 5,014,955 | 5/1991 | Thompson | 441/74 |
| 5,038,698 | 8/1991 | Winner | 114/39.2 |

FOREIGN PATENT DOCUMENTS

| | | | |
|---|---|---|---|
| 79113 | 5/1983 | European Pat. Off. | 114/140 |

*Primary Examiner*—Jesûs D. Sotelo

*Attorney, Agent, or Firm*—Nixon & Vanderhye

[57] ABSTRACT

A surfboard has one or more (e.g. three) fins extending from its bottom surface. Each fin is a rigid plastic body element (e.g. Shore D hardness of at least about 78) with curved leading and trailing edges, a base, and side walls. The edges intersect in a rounded tip, and the leading edge curves back toward the rear of the surfboard. The leading and trailing edges, but not the sides, of the fin rigid bodies are covered with a soft flexible material (e.g Shore A hardness of about 40–100), such as rubber, urethane, or silicone. The flexible elastomeric material has sufficient thickness, softness, and flexibility to protect a surfer impacted by a leading or trailing edge of the fin, and to act as a rudder (provide anti-cavitation action) to provide some board steerability by the surfer shifting his or her weight.

21 Claims, 5 Drawing Sheets 10
20
14
19
13
11
16
12
18
15

20
11
16
25
14
10
23
24
22

30
28
14
13
16
16
10
11
12
14
22
114
113
111
116
33
110
112
114
36
214
213
211
34
216
210
212
214
28
23
28
29
31

Fig. 5
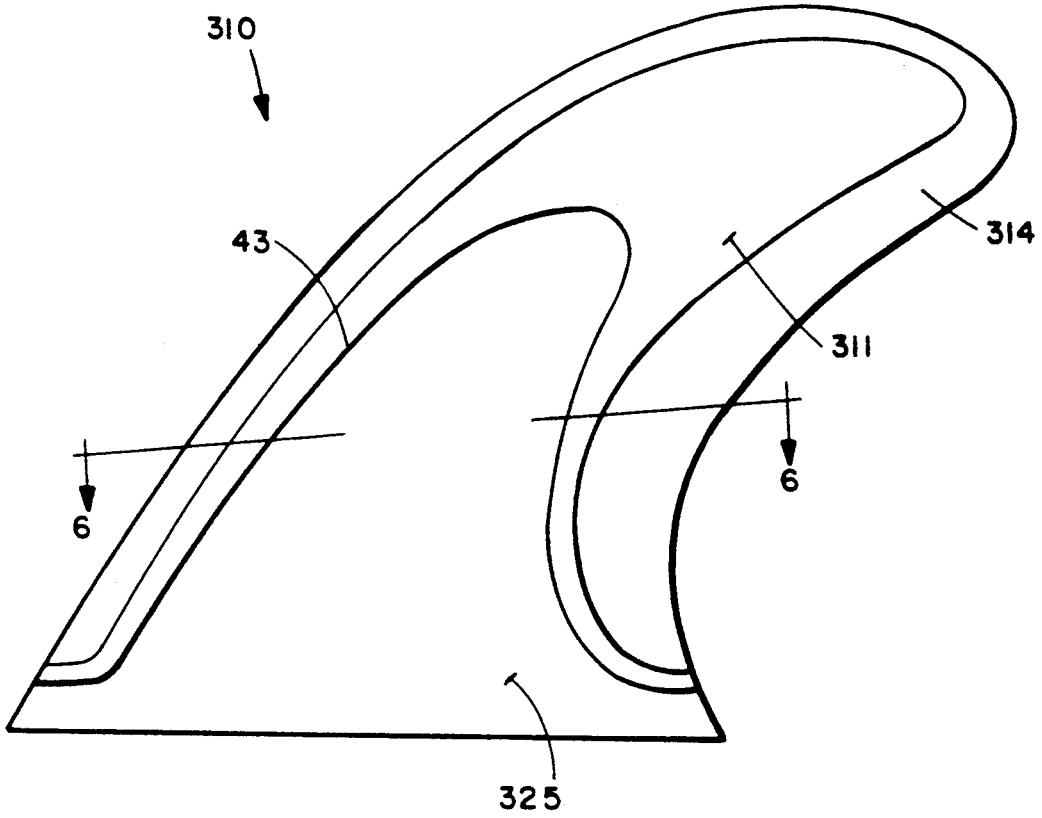
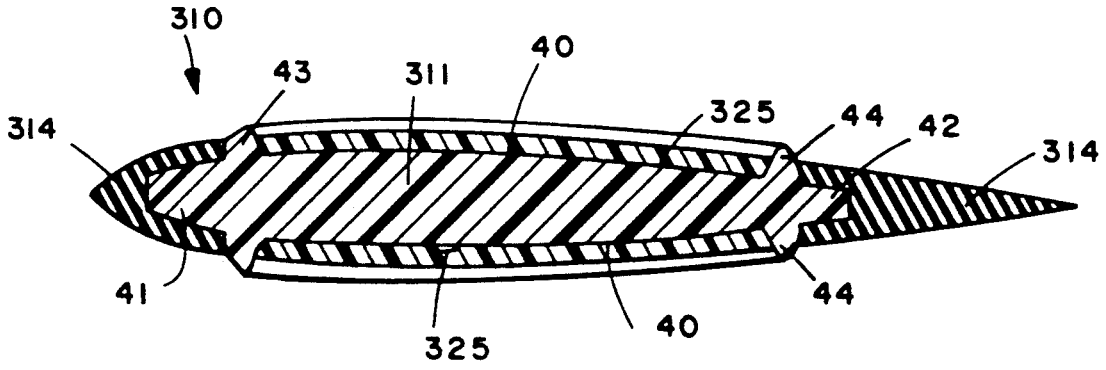
Fig. 6

Fig. 7
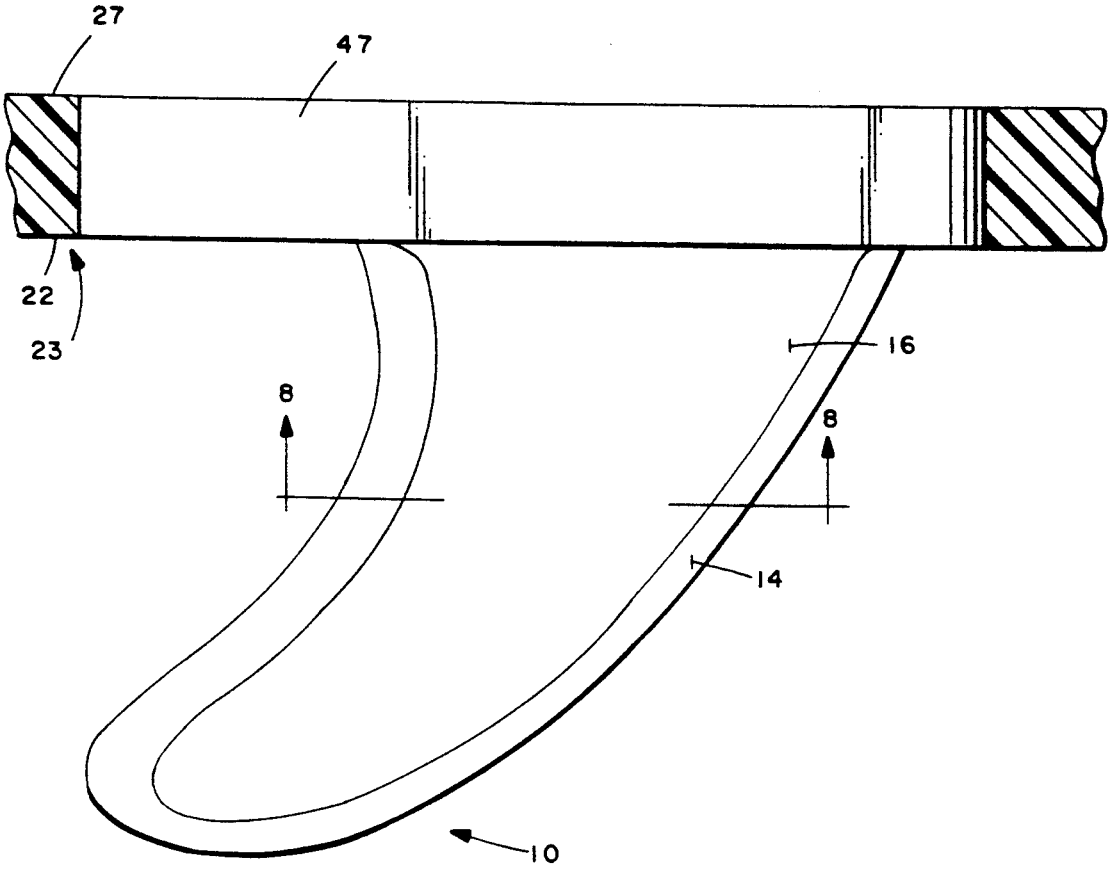
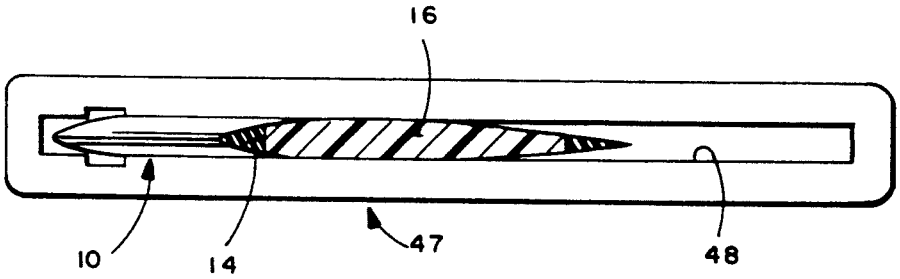
Fig. 8

SURFBOARD FINS WITH FLEXIBLE EDGES

BACKGROUND AND SUMMARY OF THE INVENTION

Modern surfboards desirably include a fin adjacent the tail thereof, and along the centerline of the board, to provide dimensional stability, to maximize board performance. While conventional fins are certainly useful for that purpose, they pose two significant problems. One is that the fin can be dangerous to surfers or nearby swimmers if the surfboard is travelling at high speed and the leading or trailing edge of the fin hits the surfer or swimmer. Also, while providing good dimensional stability, a fin may, depending upon the circumstances, restrict maneuverability.

According to the present invention a surfboard fin, and a surfboard, are provided which overcome the problems inherent in the prior art. According to the most basic aspects of the present invention, a surfboard fin or fins are provided which have soft, flexible leading and trailing edges so that if they impact a surfer or swimmer the injury will be minimized. The flexible material at the trailing edge of the fin or fins also provides a rudder action to provide maneuverability to a surfer standing on the top surface of the board and shifting his/her weight. Although numerous advantages are obtained by utilizing a single tail fin, preferably a plurality of fins are provided, e.g. three fins spaced at particular locations adjacent the tail of the board.

According to one aspect of the present invention a surfboard tail fin is provided comprising: A rigid body element having a leading edge, and a trailing edge; and a flexible material covering disposed on the leading and trailing edges of the rigid body element. The flexible material is soft enough to minimize injury to a person impacted by a leading or trailing edge of the fin, and is flexible enough to be deflected by water pressure during surfing to provide a rudder action. Preferably the rigid body element is of a hard plastic having a Shore D hardness of at least about 60 an preferably at least about 78), while the flexible material is a soft plastic (such as a urethane or silicone) having a Shore A hardness of about 40–100 (preferably about 40–94), a thickness on the trailing edge of at least about 0.25 inches, and a thickness on the leading edge of at least about 0.1 inches.

According to another aspect of the present invention a surfboard is provided having a top surface and a bottom surface, a front end (nose), and a rear end (tail). The surfboard includes at least one tail fin extending downwardly from the bottom surface adjacent the rear end. The fin comprises a rigid body element having a leading edge, and a trailing edge; and a flexible material covering disposed on the leading and trailing edges of the rigid body element, the covering material having sufficient thickness, softness and flexibility to minimize injury to a person impacted by a leading or trailing edge of the fin, and to be deflected by water pressure during surfing to provide a rudder action (anti-cavitation action) as a surfer shifts his or her weight on the top surface of the surfboard.

The surfboard according to the invention has a centerline between the front and rear ends, and preferably has three fins. A first fin is provided closest to the tail and disposed on the centerline, with the second and third fins disposed further from the tail than the first fin and off the centerline. The second and third fins are disposed approximately the same distance from the tail as each other and approximately the same distance from the centerline and on opposite sides of it, and have flat inner side faces. The leading and trailing edges of the first fin are substantially coplanar with the center plane containing the centerline. The second and third fin leading and trailing edges are in planes which makes a slight angle (e.g. about 2°–10°) to the centerline, the leading edges being slightly closer to the centerline than the trailing edges. Also the center plane is substantially vertical when the board is in use, while the planes containing the leading and trailing edges of the second and third fins are slightly off vertical (e.g. about 2° to 15°).

The fins according to the invention may be manufactured by a wide variety of techniques, including by molding both the rigid and the flexible plastics together at the same time; injection molding the flexible plastic onto the rigid plastic once it has been formed (the preferred manner); or cutting and contouring sheets or strips of flexible material and adhesively connecting them to the edges of the rigid material. The fins may be connected to the surfboard by conventional techniques utilizing fiberglass rope and fiberglass cloth impregnated in resin, the fiberglass rope extending along all portions of the enlarged base of the rigid plastic element of the fin, while the fiberglass cloth extends up along the sides of the rigid plastic portion of the fins. The fin sides can be concave where they receive the fiberglass, and have ridges which protect the flexible material edges of the fin.

Alternatively, the fin can be removable, e.g. mounted in a conventional fin box.

It is the primary object of the present invention to provide a surfboard fin, and surfboard containing at least one fin, having enhanced safety and maneuverability characteristics. This and other objects of the invention will become clear from an inspection of the detailed description of the invention and from the appended claims.

BRIEF DESCRIPTION OF THE DRAWINGS

FIG. 5 is a side view of a second embodiment of an exemplary fin according to the invention;

FIG. 6 is a cross-sectional view taken along lines 6—6 of FIG. 5;

FIG. 7 is a side elevational view of the fin of FIG. 1 in a fin box mounted within a surfboard, the surfboard being shown in cross-section; and FIG. 8 is a bottom plan view of the fin and fin box of FIG. 7 with the fin sectioned along lines 8—8.

DETAILED DESCRIPTION OF THE DRAWINGS

Figures 1, 2:
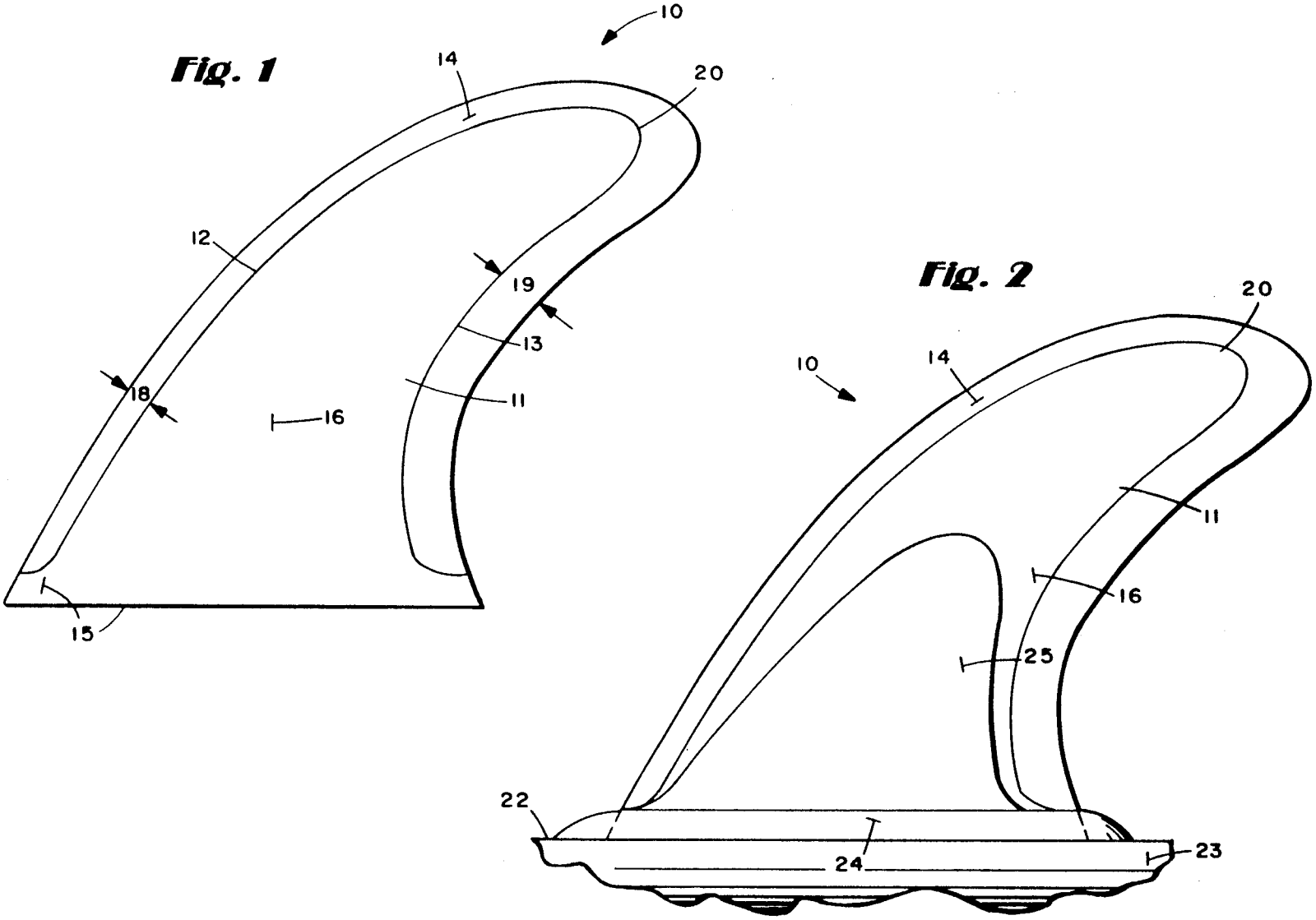
FIG. 1 is a side view, essentially actual size in scale, of an exemplary fin according to the present invention.
FIG. 2 is a side view of the fin of FIG. 1 shown connected to the bottom of a surfboard.

An exemplary fin according to the present invention is shown generally by reference numeral 10 in the drawings. The fin preferably consists essentially of two basic components, a rigid plastic body element 11 having a curved leading edge 12, and a curved trailing edge 13, and a soft, flexible elastomeric material covering 14 disposed on the edges 12, 13, except at the enlarged width base 15 of the rigid element 11. The element 11 has a pair of side faces 16 (see FIGS. 1 and 4), which are slightly convex (i.e. foil shaped) and it is preferred that the soft flexible material 14 not cover substantial (or even any) portions of the side faces 16.

The rigid, hard plastic element 11 may be made of a wide variety of materials, but it is highly desirable that the material be entirely compatible with fiberglass cloth and rope, which preferably are used to secure the fin 10 on a surfboard. The material of element 11 also preferably is compatible with the soft flexible plastic forming the material 14 so that the two do not have a tendency to separate in use. Preferably the hard plastic element 11 has a Shore D hardness of at least about 60, and preferably at least about 78. For example it may be a 2102 series (e.g. 2102-80D) polyester polycaprolactone such as sold under the trademark Pellethane®.

The soft flexible material 14 preferably is rubber, or a plastic such as a silicone or a urethane, but regardless of the material it has sufficient softness so as to minimize injury to a person impacted by a leading or trailing edge of the fin 10, and it is flexible enough to be deflected by water pressure during surfing to provide a rudder action (anti-cavitating action). That is, it has a thickness, softness, and flexibility to perform these functions, the rudder action being provided as a surfer shifts his or her weight on the top surface of the surfboard with which the fin 10 is associated. While a wide variety of materials may be utilized, preferably the flexible elastomeric material 14 has a Shore A hardness of about 40-100 (preferably about 40-94), such as provided by a class of polyurethane elastomers sold under the Pellethane® trademark, comprising 2102 series polyester polycaprolactones, designations 2102-75A, 80A, 80AE, 85A, 90A, and 90AB.

In a preferred embodiment, the thickness 18 of the material 14 along the leading edge 12 is at least about 0.1 inches, and preferably about 0.3 inches, while the thickness 19 along the trailing edge 13 is at least about 0.25 inches (and may vary along the length of edge 13), and preferably is at least about 0.5 inches.

While the shape of the fin 10 may vary, a particularly useful shape is that illustrated in the drawings, wherein the leading edge 12 curves back toward the trailing edge 13, and the edges 12, 13 intersect at a rounded tip 20 remote from the surfboard. The tip 20 also is covered by the flexible material 14, as illustrated.

The fin 10 according to the invention may be constructed in a number of different ways. For example depending upon the equipment and the materials utilized and available, the hard plastic element 11 and the soft plastic edges 14 can be injection molded at the same time. Alternatively, a hard plastic element 11 may be inserted in a mold disposed along the edges thereof, and the flexible material 14 molded in place. Still further, sheets or strips of urethane or silicone can be cut and shaped so that they correspond to the edges 12, 13 of the element 11, and they may be attached in place on the edges 12, 13 with a compatible adhesive.

Figure 3:
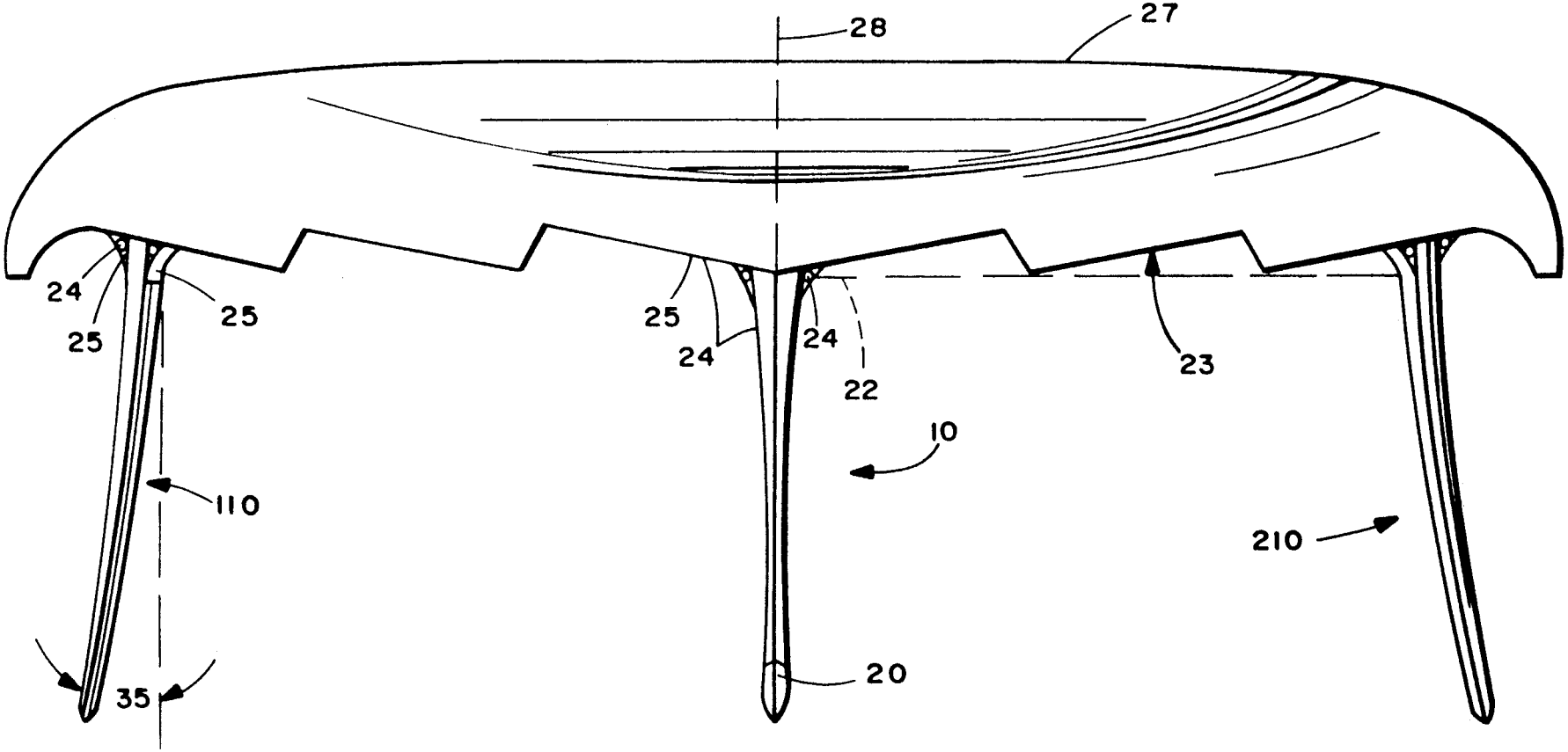
FIG. 3 is a rear cross-sectional view of a surfboard having three fins similar to those of FIGS. 1 and 2, during construction.

FIGS. 2 and 3 illustrate a preferred way in which the fin (or fins) 10 is attached to a bottom surface 22 of a surfboard 23. It is to be understood that in the present specification and claims that the term "surfboard" is to be interpreted broadly to encompass what are colloquially known as surfboards, windsurfing boards, water ski boards, and the like; that is the term "surfboard" encompasses all water sport boards which may use a fin.

The manner in which the fin 10 according to the invention is applied to the surfboard bottom surface 22 is basically conventional. That is fiberglass rope 24 (see FIG. 2) soaked in resin is applied along both sides of the fin 10 at the base 15, while fiberglass cloth 25, soaked in resin, is applied upwardly along the sides 16. Such a construction essentially ensures that the fin 11 is integral with the board, and forms a part of it, with no unnecessary drag as a result of connection of the fin 10 to the board 23.

Figure 4:
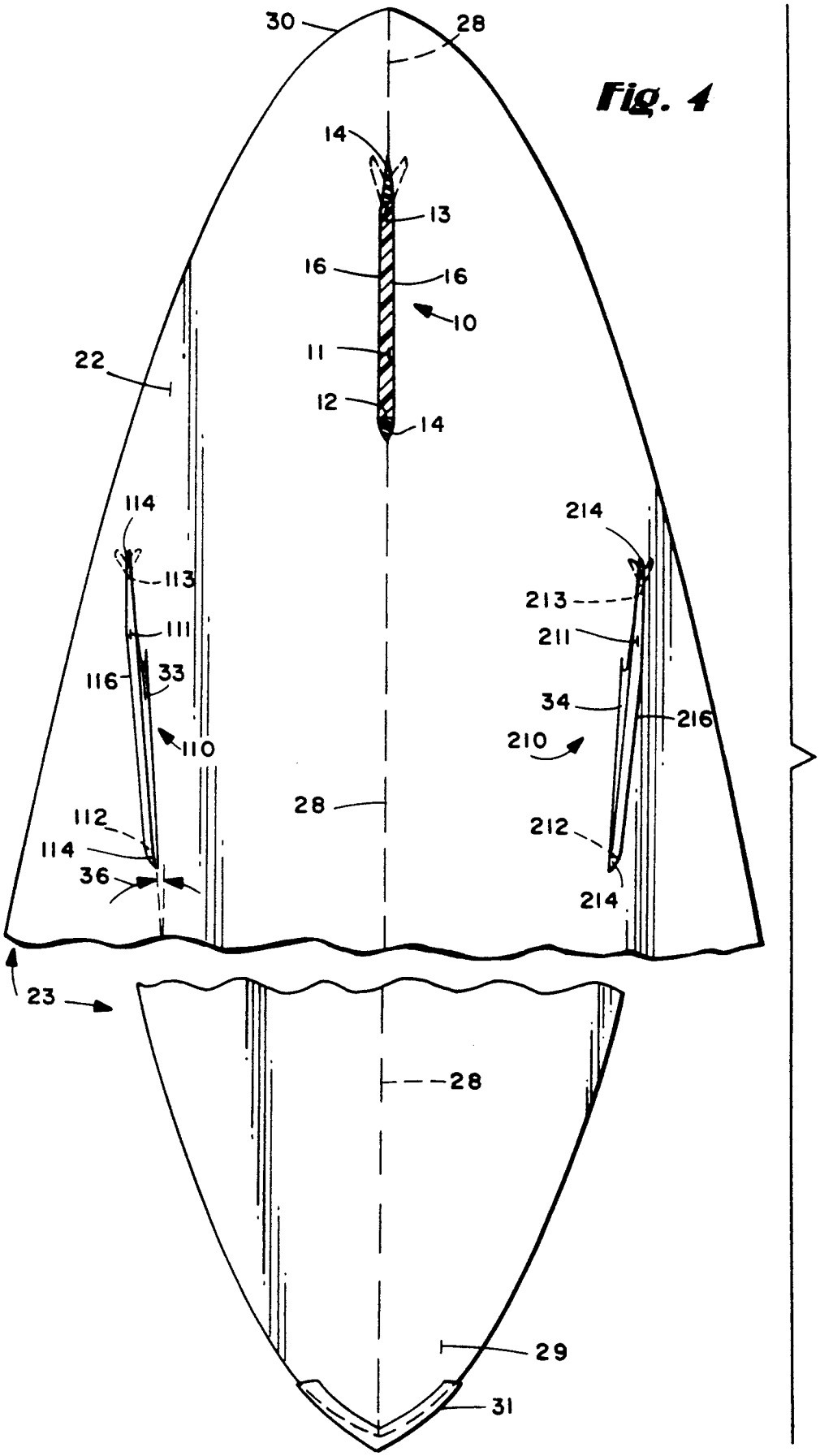
FIG. 4 is a bottom view of a final surfboard like that of FIG. 3 with the fins sectioned along horizontal planes, and showing the flexible trailing edges in dotted line position, illustrating a rudder effect.

The particular orientation of one or more fins according to the present invention with respect to a surfboard 23 is illustrated in FIGS. 3 and 4. The surfboard 23 has a bottom surface 22 (FIGS. 2 through 4), and a top surface 27 (see FIG. 3). The surfer stands or kneels or lays on the top surface 27. The board 23 also has a centerline 28, (see FIG. 4). Preferably the pointed tip of the nose 29 has a protective tip 31, such as shown in U.S. Pat. No. 4,792,316, the disclosure of which is hereby incorporated by reference herein.

As can be seen in both FIGS. 3 and 4, preferably the fin 10, comprising a first fin, is disposed along the centerline 28 of the surfboard 23, and is in substantially a vertical plane in use, that is a plane containing edges 12, 13 is substantially perpendicular to the bottom surface 22 of the surfboard 23.

According to the invention, the soft flexible material 14 does not adversely affect the performance characteristics of the board to any significant extent, while providing a surfer-protecting function. As a matter of fact, the maneuverability of the board is increased according to the invention. While the soft flexible material 14 along the leading edge 12 (see FIG. 4) provides a substantial protective function, minimizing the injury to surfers or swimmers impacted by the leading edge of the fin 10, the material 14 on the trailing edge 13 not only provides this protecting function but also provides a rudder action (anti-cavitation action). When the water pressure acts on the material 14 along the trailing edge 13 during surfing, the material 14 may flex to the dotted line positions illustrated in FIG. 4. Thus a surfer standing on the top surface 27 of the surfboard 23 can utilize this rudder action to steer/maneuver the surfboard 23 by shifting his or her weight on the surfboard 23.

While the utilization of one fin 10 according to the invention is highly advantageous, some surfers—depending upon skill level—will obtain optimum results by utilizing a plurality of fins (e.g. two, three, four, or five), such as the fins 110 and 210 in addition to the fin 10. The arrangement of three fins in FIG. 4 is known per se (for conventional rigid fins).

As seen in FIGS. 3 and 4, the fins 110, 210 —comprising second and third fins—have the same basic construction as the fin 10 as far as the rigid plastic element 111 and 211 is concerned, and the soft flexible material 114, 214 on the leading edges 112, 212, respectively, and additional flexible material 114, 214 on the trailing edges 113, 213, respectively. The only things different about the fins 110, 210 are their flat (water release) inner faces 33, 34, respectively, and their placement on the bottom surface 22 of a surfboard 23.

The fin 10 is closer to the tail 30 than the fins 110, 210, and preferably the fins 110, 210 are spaced the same distance from the tail 30, and are disposed on opposite sides of the centerline 28, spaced equidistance from it.

The fins 110, 210 are also preferably tilted slightly about both vertical and horizontal axes. That is they make a slight angle 35 (see FIG. 3) with respect to the vertical when the board is in use, the angle 35 preferably being about 2°–15°. Also, they make a slight angle 36 (see FIG. 4) with respect to the centerline 28 so that the trailing edges 113, 213 of each are spaced slightly further from the center line 28 than the leading edges 112, 212 thereof. The angle 36 preferably is about 2°–10°. That is, the fins 110, 210 are toed in for better performance (typically increased speed).

FIGS. 5 and 6 illustrate another embodiment of fin according to the invention, designed to readily accommodate "glassing" of the fin onto a surfboard. In the FIGS. 5 and 6 embodiment structures comparable to those in the FIG. 1 embodiment are illustrated by the same two digit reference numeral only preceded by a "3".

In the FIGS. 5 and 6 embodiment, the rigid plastic body element 311 of the fin 310 has concave side faces 40, a front portion 41, and a rear portion 42. The concave faces 40 are defined by the leading ridges 43 and trailing ridges 44, each set of ridges 43, 44 meeting at a top portion, as illustrated in FIG. 5. The flexible elastomeric material 314 is received by the front and rear portions 41, 42 as indicated in FIG. 6.

The slight ridges 43, 44 on the perimeter of the concave faces 40 of the fin 310 direct the resin impregnated fiberglass 35 away from the soft outer edges of the fin 310 defined by the material 314. When the fin 310 is sanded, the excess glass will be lifted away from the outer edges, making it easier to remove. The material 314 also may be coated with a releasing agent during construction to prevent the resin associated with the fiberglass 325 from adhering to it, therefore enhancing the ease of removal of excess glass and resin. The glass 325 of course attaches the fin 310 to the surfboard in the same manner as the glass 25, and may also be associated with fiberglass rope, or the like.

In the previous embodiments, the fins 10, 310, etc. have been shown as permanently affixed to a surfboard 23. Alternatively, the fins may be removable. As seen in FIGS. 7 and 8, the fin 10 is mounted in a conventional fin box 47, so that it is removable from the surfboard 23. The conventional fin box 47 has a channel 48 formed in the bottom thereof for receipt of the fin 10. The manner in which the fin 10 is removably held within the channel 48 is conventional, and may vary, and may be such as shown in U.S. Pat. No. 3,564,632 or U.S. Pat. No. 4,421,492.

It will thus be seen that according to the present invention a surfboard fin, and a surfboard with one or more fins, having enhanced safety and maneuverability, are provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A surfboard fin comprising:

a rigid body element having a leading edge, and a trailing edge, and a flexible material covering disposed on said leading and trailing edges of said rigid body element, said flexible material being soft enough to minimize injury to a person impacted by a leading or trailing edge of said fin, and being flexible enough to be deflected by water pressure during surfing to provide a rudder, anti-cavitation, action;

wherein said rigid body element has a base and side faces, said flexible material not disposed on said side faces; and wherein said base has a width much greater than the width of the rest of said rigid body element.

2. A fin as recited in claim 1 wherein said flexible material is selected from the group consisting essentially of rubber, silicones, and urethanes.

3. A fin as recited in claim 1 wherein said rigid body element has a rounded tip at an intersection between said leading and trailing edges, and both said leading and trailing edges are curved, said leading edge curved toward said trailing edge.

4. A surfboard fin consisting of:

a rigid plastic body element having a leading edge, and a trailing edge, and having a Shore D hardness of at least about 60; and a flexible elastomeric material covering, having a Shore A hardness of about 40–100, disposed on said leading and trailing edges of said rigid plastic body element, but not disposed on significant portions of said rigid plastic body element except said leading and trailing edges, said covering having a thickness on said trailing edge of at least about 0.25 inches, and a thickness on said leading edge of at least about 0.1 inches.

5. A fin as recited in claim 4 wherein said flexible material is selected from the group consisting essentially of rubber, silicones, and urethanes.

6. A fin as recited in claim 5 wherein said flexible material has a Shore A hardness of about 50–94, and said rigid plastic body has a Shore D hardness of at least about 78.

7. A fin as recited in claim 4 wherein said rigid body element has a base and side faces, said flexible material not disposed on said side faces; and wherein said base has a width much greater than the width of the rest of said rigid body element.

8. A fin as recited in claim 7 wherein said rigid body element has a rounded tip at an intersection between said leading and trailing edges, and both said leading and trailing edges are curved, said leading edge curved toward said trailing edge.

9. A surfboard having a top surface and a bottom surface, a front end, and rear end; and at least one fin extending downwardly from said bottom surface adjacent said rear end, said fin comprising: a rigid body element having a leading edge, and a trailing edge; and a flexible material covering disposed on said leading and trailing edges of said rigid body element, said covering material having sufficient thickness, softness and flexibility to minimize injury to a person impacted by a leading or trailing edge of said fin, and to be deflected by water pressure during surfing to provide a rudder, anti-cavitation, action as a surfer shifts his or her weight on the top surface of the surfboard; and wherein said rigid body element of said fin has a base, and sides, and is connected to said bottom surface of said surfboard by resin impregnated fiberglass rope at said base, and resin impregnated fiberglass cloth along said sides.

10. A surfboard as recited in claim 9 wherein said surfboard has a centerline between said front end and said rear end, and has three of said fins, a first fin closest to said rear end of said surfboard and disposed on said centerline, and second and third fins disposed further from said rear end than said first fin, and off said centerline.

11. A surfboard as recited in claim 10 wherein said second and third fins are disposed approximately the same distance from said rear end as each other, and approximately the same distance from said centerline and on opposite sides thereof.

12. A surfboard as recited in claim 11 wherein said first fin leading and trailing edges are substantially coplanar with a center plane containing said centerline, while said second and third fin leading and trailing edges are in planes which make a slight angle with respect to said center plane, the leading edges of said second and third fins being slightly closer to said centerline than the trailing edges thereof.

13. A surfboard as recited in claim 12 wherein said planes containing said leading and trailing edges of said second and third fins are slightly off vertical in use, while said center plane is substantially vertical in use.

14. A surfboard as recited in claim 10 wherein each fin consists of a rigid plastic body element having a leading edge, and a trailing edge, and having a Shore D hardness of at least about 60; and a flexible elastomeric material covering, having a Shore A hardness of about 40–100, disposed on said leading and trailing edges of said rigid plastic body element, but not disposed on significant portions of said rigid plastic body element except said leading and trailing edges, said covering having a thickness on said trailing edge of at least about 0.25 inches, and a thickness on said leading edge of at least about 0.1 inches.

15. A surfboard as recited in claim 10 wherein each of said fin rigid body elements has a rounded tip at an intersection between said leading and trailing edges, and both said leading and trailing edges are curved, said leading edge curved toward said rear end of said surfboard.

16. A surfboard as recited in claim 9 wherein said base of said rigid body element is not covered by said flexible material covering.

17. A surfboard as recited in claim 9 wherein said fin rigid body element has concave side surfaces receiving fiberglass cloth thereon.

18. A surfboard as recited in claim 9 further comprising a fin box removably mounting said fin.

19. A surfboard as recited in claim 9 wherein said flexible material is selected from the group consisting essentially of rubber, silicones, and urethanes.

20. A surfboard having a top surface and a bottom surface, a front end, and a rear end;

at least one fin extending downwardly from said bottom surface adjacent said rear end, said fin comprising: a rigid body element having a leading edge, and a trailing edge; and a flexible material covering disposed on said leading and trailing edges of said rigid body element, said covering material having sufficient thickness, softness and flexibility to minimize injury to a person impacted by a leading or trailing edge of said fin, and to be deflected by water pressure during surfing to provide a rudder, anti-cavitation, action as a surfer shifts his or her weight on the top surface of the surfboard; and said fin rigid body element having a Shore D hardness of at least about 60; and said flexible elastomeric material covering, having a Shore A hardness of about 40–100, and disposed on said leading and trailing edges of said rigid body element, but not disposed on significant portions of said rigid body element except said leading and trailing edges.

21. A surfboard as recited in claim 20 wherein said flexible material is selected from the group consisting essentially of rubber, silicones, and urethanes.

* * * * *